United States Patent [19]

Roberts

[11] Patent Number: 4,654,906

[45] Date of Patent: Apr. 7, 1987

[54] BEACH BLANKET WITH SAND POCKETS

[76] Inventor: Barry N. Roberts, 102 Christopher St., New York, N.Y. 10014

[21] Appl. No.: 595,584

[22] Filed: Apr. 2, 1984

[51] Int. Cl.[4] ..... A47G 9/06; B32B 3/08

[52] U.S. Cl. ..... 5/417; 428/81; 428/102; 428/192

[58] Field of Search ..... 428/81, 82, 99, 102, 428/192; 5/417, 419, 420

[56] References Cited

U.S. PATENT DOCUMENTS

| | | | |
|---|---|---|---|
| 2575 | 6/1876 | Jones | 5/419 |
| 3,226,737 | 1/1966 | Rote | 5/417 |

*Primary Examiner*—Alexander S. Thomas

*Attorney, Agent, or Firm*—Rosen, Dainow & Jacobs

[57] ABSTRACT

A beach blanket having rectangular shape and four corners has a right triangular pocket at each corner to receive and temporarily hold a quantity of sand for anchoring the blanket, the pockets being closable to secure the sand therein and openable for discharge of the sand.

4 Claims, 2 Drawing Figures

BEACH BLANKET WITH SAND POCKETS

BACKGROUND OF THE INVENTION

The invention relates generally to beach blankets or beach towels, and is more specifically directed to techniques and devices for preventing the corners of the blankets from being blown and folded over by the wind or wrinkled by accidental kicking.

A typical and well-known problem or nuisance for persons who visit beaches and spread beach blankets on the sand is having the corners and edges of the blanket blown, kicked or pulled over onto the central portion of the blanket. This obviously reduces the size of the blanket and increases the likelihood of sand landing on the central portion. Such a wrinkled or folded blanket or one having sand in the area contacted by the bather's bare skin is usually irritating and has been a perpetual problem for beach-goers.

Many techniques are used in attempts to keep the beach blankets flat and fully extended, the most common being to place shoes, clothing or other beach paraphernalia on the corners or along the edges of the blanket. Sometimes the corners are tied to stakes pounded into the sand, or the stakes may be pounded into the corner of the blanket.

All of these make-shift solutions include practical problems or disadvantages. When clothing or other objects are used as weights the total area of the blanket available to the bather is reduced. Also, the use of such objects as weights is temporary until the objects are needed for their intended purpose, leaving the blanket again susceptible to wind and human forces that invariably result in flipped corners and the unpleasantness of a sand-laden central part of the blanket.

Often one does not have a sufficient number of articles to weigh down the corners. When stakes are employed the user has the burden of transporting, installing and removing them. Furthermore, the exposed ends of the stakes constitute a serious danger for persons using the blanket and others who pass by.

Accordingly, it is an object of the present invention to provide a beach blanket which has its own built-in devices for holding the corners down, and to do so without sacrificing surface area. It is a further object that the built-in devices will utilize for weight material found naturally on the beach, thus relieving the user from having to carry any additional objects. An additional object is to avoid the use of potentially dangerous objects such as stakes.

SUMMARY OF THE INVENTION

The invention comprises the provision of pockets on the edges of a blanket, which pockets are capable of receiving and holding a quantity of sand until the user decides to empty the pockets when leaving the beach. Preferably the new blanket is rectangular, having four triangular corners, the invention then comprising a triangular pocket at each corner, wherein each pocket may be attached or attachable to the blanket or each pocket may utilize the fabric of the blanket for at least one layer of the pocket. In this latter case the added layer may be an overlay of a congruent right triangular sheet upon the triangular corner. In another alternative, two rectangular blankets are secured together in overlaying relationship, where their overlying corners can constitute the two layers of triangular pockets. Obviously, other shapes of blankets are feasible with other shapes of pockets, so long as such pockets are on one or more of the peripheral edges of the blanket. Each pocket, regardless of its particular shape, must be readily openable to receive or discharge a quantity of sand and readily sealable for holding such sand during the period of use. As the sand-filled pockets weigh down the corners and keep the edges of the blanket extending between the corners essentially flat with no additional objects atop the blanket, obviously the usable area of the blanket's surface remains undiminished.

A more complete appreciation of the invention and its features will be readily apparent by reference to the following detailed description considered in connection with the accompanying drawing.

DETAILED DESCRIPTION OF THE PREFERRED EMBODIMENTS

The two embodiments shown and described are rectangular beach blankets or towels having pockets located at their corners which may be temporarily filled with sand to provide weight at these corners so as to inhibit the corners from flipping or the blanket edges from ruffling.

Figure 1:
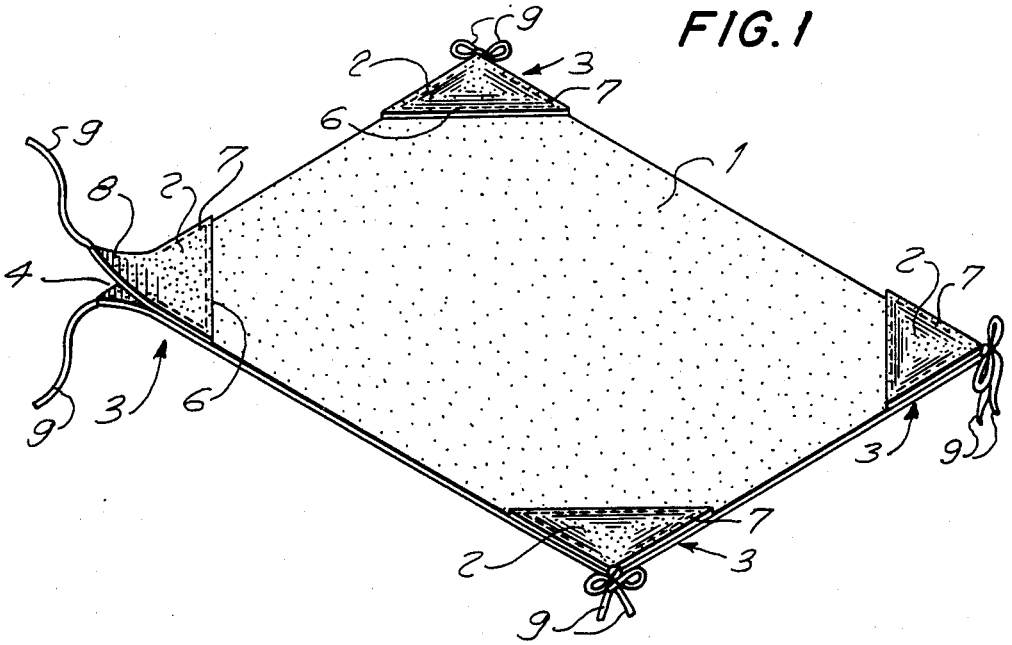
FIG. 1 is a top perspective view of a first embodiment of the invention.

In FIG. 1, the new beach blanket or beach towel comprises a base sheet 1 of rectangular shape, usually of cotton terry cloth and having four corners as shown. Triangular sheets 2 are attached at each of the four corners of the base sheets so that pockets 3 are formed between the two layers at each corner. Opening 4 to each pocket is formed by leaving the top of the right angle part of each right triangular pocket unattached to the base sheet while the remaining edges of the layer 2 are attached to the base sheet by stitching. Thus, the hypotenuse and parts of the legs of the triangular layer 2 are sewn to the base, leaving unsewn the included right angle tip 8.

A piece of string or ribbon 9 is attached to the tips of each layer of each pocket and should be of sufficient length to be joined and tied. Pockets filled with sand are easily closed by tying together the ribbon strings, and later easily opened and emptied by shaking and orienting the opening to direct the sand away from the central portion of the blanket.

Figure 2:
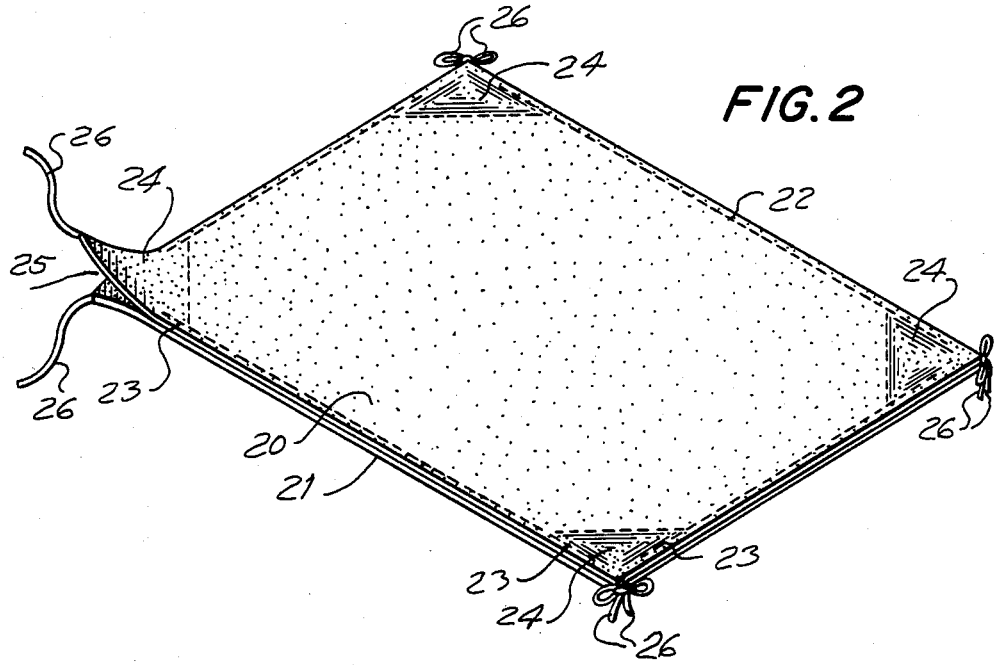
FIG. 2 is a top perspective view of a second embodiment of the invention.

FIG. 2 shows a second embodiment of the invention where a pair of rectangular sheets 20, 21 are in congruent and overlying relationship and sewn together along the dotted line which defines an eight-sided polygon 22 and along lines 23 which are partial legs of the right triangle of each pocket. The result of such stitching is a set of four triangular pockets 24 at the corners, each having an opening 25 at the corners, each having an opening 25 at the right tip, and each having the strings 26 to releasably close the pocket.

Many different materials may be selected for the beach blankets, the preferred being terry cloth. Likewise, a choice of fasteners is available to seal pockets, including ribbons, string, or other fastening means such as engaging strips of VELCRO® tape used in the typical manner. Also the triangular layers 2 in FIG. 1 may be removably secured to the base sheet by VELCRO® tape or by other means. Alternatively complete two-layered pockets may be secured to a base sheet. The pockets in all the embodiments may be lined with a waterproof layer such as plastic, sailcloth or nylon to keep the sand dry even if water or other liquid comes in contact with the blanket.

It is clear that one skilled in the art can create various modifications of the embodiments shown without departing from the scope of this invention as defined in the following claims.

I claim:

1. A beach blanket operable with a plurality of weighting means, comprising a single base sheet having a central part and a peripheral edge, a plurality of pockets at selected locations on said peripheral edge, each pocket having an opening which faces outwardly for receiving one of said weighting means, and means for releasably closing each of said outwardly facing openings, said base sheet having rectangular shape with four right triangular corners, and each of said pockets has right triangular shape congruent with one of said corners.

2. A beach blanket according to claim 1, wherein said right triangular base sheet corners each have a right angle tip and each of said pockets includes a right triangular shaped second sheet having a right angle tip, each second sheet overlying one of said right triangular base sheet corners with the right angle tips of said base and second sheets positioned in overlying relationship, said second sheets being secured to said right triangular base sheet corners along all edges except near said base and second sheet right angle tips to define said outwardly facing openings.

3. A beach blanket according to claim 2, wherein said releasable closing means comprises a first string attached to the tip of said base sheet and a second string attached to the tip of said second sheet.

4. A beach blanket operable with a quantity of sand, comprising first and second rectangular sheets in congruent and overlying relationship, a right triangular pocket at each corner of the blankets formed by a line of stitching extending along the hypotenuse of the right triangle and along the sides extending from the hypotenuse toward but not reaching the included right angle of each triangle thereby defining an opening in each pocket at the tip portion of the right angle corner thereof, and means for releasably closing each of said pockets, each pocket when open adapted to receive and hold a quantity of sand.

* * * * *